United States Patent [19]

Kumazawa

[11] Patent Number: 4,965,923

[45] Date of Patent: Oct. 30, 1990

[54] APPARATUS FOR CONNECTING A CONNECTOR HEAD HAVING A PAIR OF COVER ADAPTORS WITH A CABLE

[75] Inventor: Hiroshi Kumazawa, Akishimashi, Japan

[73] Assignee: Japan Aviation Electronics Industry, Inc., Tokyo, Japan

[21] Appl. No.: 405,546

[22] Filed: Sep. 11, 1989

[30] Foreign Application Priority Data

Oct. 5, 1988 [JP] Japan ..... 63-249814

[51] Int. Cl.[5] ..... H01R 43/00

[52] U.S. Cl. ..... 29/566.3; 29/749; 29/753

[58] Field of Search ..... 29/749, 747, 753, 566.1, 29/566.4, 566.3

[56] References Cited

U.S. PATENT DOCUMENTS 4,349,944 9/1982 Fickes ..... 29/749 X

*Primary Examiner*—Carl E. Hall

*Attorney, Agent, or Firm*—Bierman and Muserlian

[57] ABSTRACT

A method and apparatus for connecting an electrical connector with a cable. The electrical connector including a connector head having a plurality of contacts and a pair of cover adaptors to which wires of the cable may be arranged is connected with the cable by means of the apparatus including a press section, a die-set section and a slide-unit section. The head is supported to a portion of the apparatus, and the cover adaptors to which cables are arranged are respectively attached to the head by a single operation of a handle of the apparatus whereby the wires are connected with the respective contacts.

5 Claims, 9 Drawing Sheets

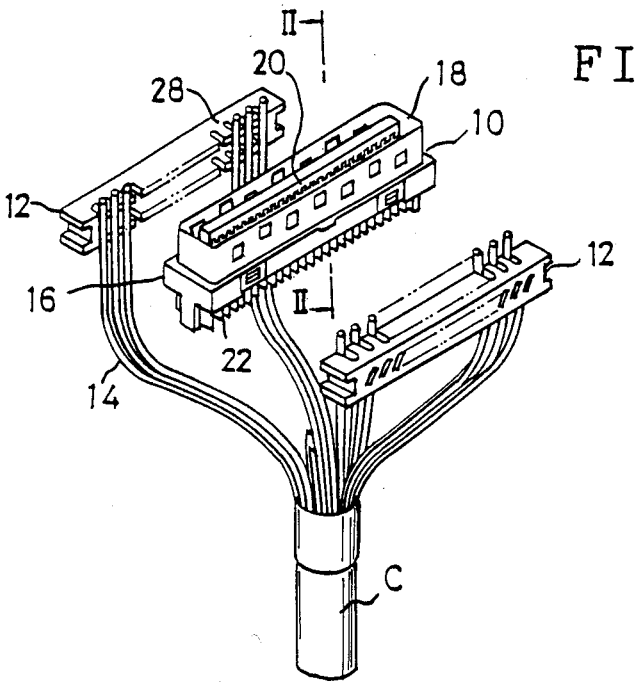
FIG. 1
FIG. 2
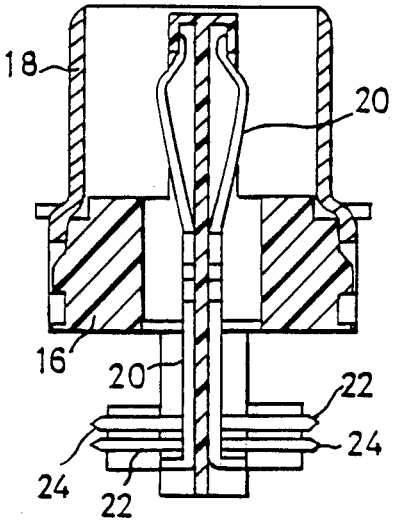
FIG. 3
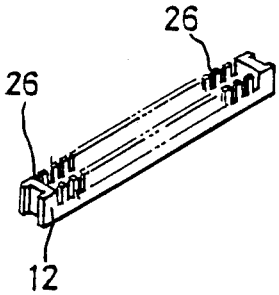

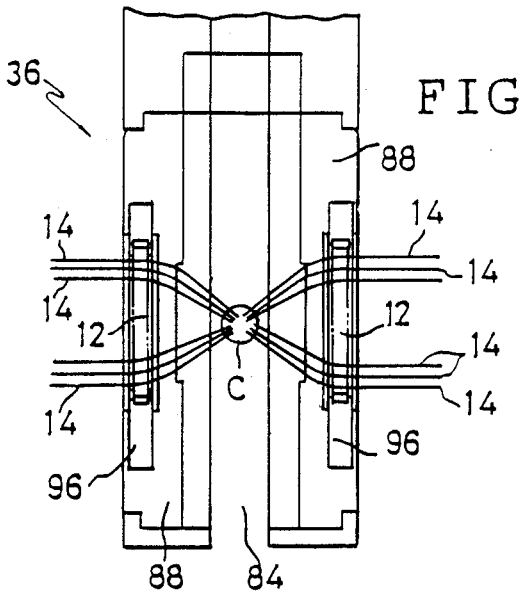
FIG. 17
FIG. 18
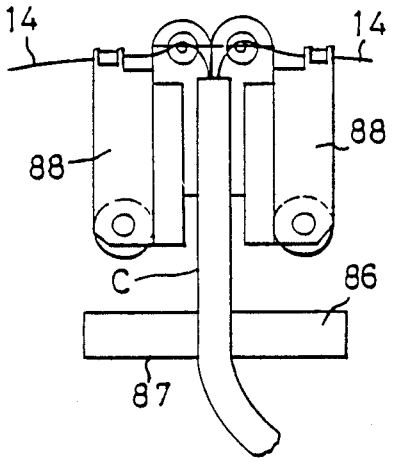

APPARATUS FOR CONNECTING A CONNECTOR HEAD HAVING A PAIR OF COVER ADAPTORS WITH A CABLE

FIELD OF THE INVENTION

This invention relates to a method and apparatus for connecting an electrical connector with a cable, and more particularly to a method and apparatus connecting a number of contacts arranged in a rectangular connector with free ends of individual wires in a single cable or flat ribbon cable.

BACKGROUND OF THE INVENTION

Usually rectangular connectors are used for connecting electronic equipment or circuits each other.

The following steps have been taken to connect a plurality of wires in a single cable with respective contacts arranged in the rectangular connector head:

(1) An adhesive tape is applied to a cover adaptor of the connector to bond a cable insulation to a connector head.

(2) Free ends of wires in a single cable are inserted into respective grooves in the cover adaptor by the use of a special tool.

(3) The wire is arranged and secured to a cover adaptor by the use of a special tool.

(4) The cover adaptor to which the wires are secured is mounted on a connector head by the use of another tool.

Accordingly, the conventional method mentioned above has recognized disadvantages in that the method is very complicated and difficult to connect the connector head with the cable by the use of a single apparatus.

OBJECTS OF THE INVENTION

In view of the foregoing, it is an object of the present invention to provide a method for connecting an electric connector head with a cable, which is very simple in operation.

It is an object of the present invention to provide an apparatus for connecting a plurality of contacts in a rectangular connector head with respective insulated wires in a cable or flat ribbon cable, which is mechanically simple and inexpensive to manufacture.

In order to accomplish the foregoing objects the method of the present invention consists of:

(1) a step for supporting a pair of cover adaptors in parallel to each other in the horizontal position and for inserting free ends of insulated wires of a cable into respective grooves in the surface of each of the cover adaptors;

(2) a step for turning the cover insulators for 90 degrees from their horizontal position to face the grooved surfaces of the cover insulators each other; and (3) a step for applying external force to each of the cover adaptors to mount it on the rectangular connector head whereby the insulated wires may be inserted into the insulation piercing portions of the contact elements mounted in the head.

BRIEF DESCRIPTION OF THE DRAWINGS

FIG. 1 is an exploded perspective view of a connector head to be assembled according to the invention;

FIG. 2 is an enlarged sectional view, looking in the direction of the arrows along line II—II of FIG. 1;

FIG. 3 is a schematic perspective view of a cover adaptor of the connector head;

FIG. 17 is a plan view in which the coated conductors of the cable are placed in the cover adaptor mounted in the cover adaptor support means;

FIG. 18 is a schematic elevation of FIG. 17; and

DESCRIPTION OF A PREFERRED EMBODIMENT

Figure 4:
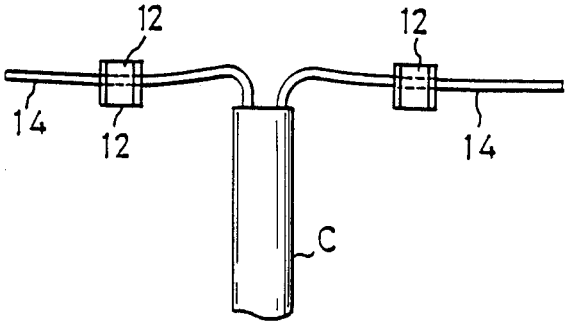
FIG. 4 is a schematic elevation showing coated conductors of a cable, each of which is located in the cover adaptor.

Referring now in more detail to the drawings, wherein like reference characters designate identical or corresponding parts throughout the several views.

According to the present invention, as shown in FIG. 1, a rectangular electrical connector head 10 which has been specifically designed for the mass termination of wires includes a plurality of connector contact elements and a pair of cover adaptors 12 of molded dielectric material having a plurality of grooves 26 shaped to receive the free end of the wire and a plurality of coated conductors or wires 14 of a cable or flat cable C are inserted into the insulation piercing portions of the contact elements mounted in the connector head 10.

The rectangular connector head 10 of the mass termination type is generally well-known in the art and, as shown in FIGS. 1 and 2, the head 10 includes a base member 16 made of dielectric material and a metal hood 18. On the both sides of the base member 16, a plurality of contact elements 20 are arranged in line.

A lower end 22 of the contact 20 is exposed at the lower side of the base member 16 and bent at an angle of 90° with respect to the longitudinal axis thereof. The lower end 22 is formed by two portions with a slit 24 so as to insert the conductor or wire into the slit 24.

Figure 7:
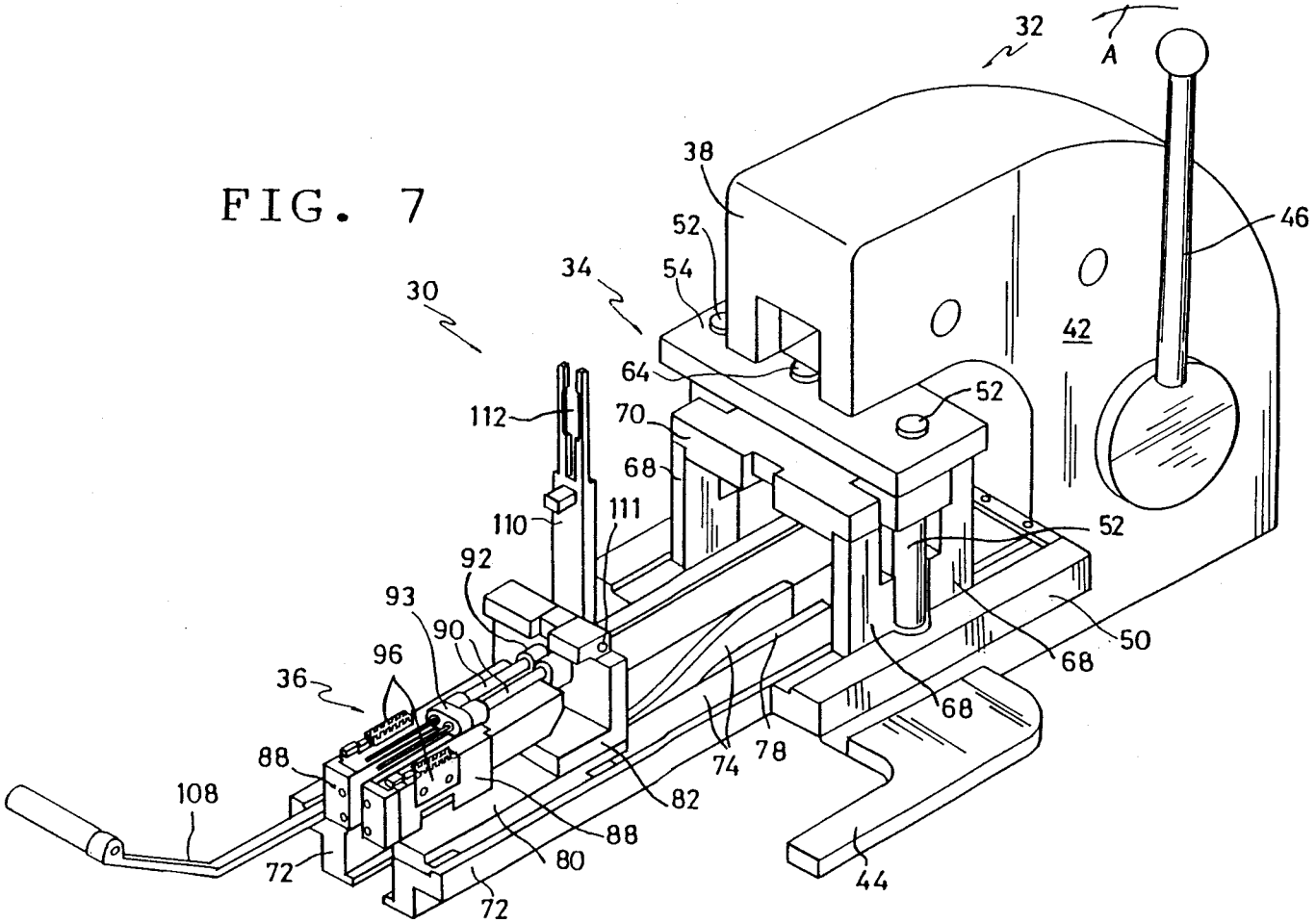
FIG. 7 is a perspective view of the apparatus of a preferred embodiment according to the invention.

In accordance with the present invention, each of a plurality of the coated electrical conductors or wires 14 is arranged and placed in each of the grooves 26 in the cover adaptor 12 and then the adaptor 12 is attached to the connector head 10 so as to align conductors 14 arranged in each of the adaptors with the respective contact members 20 in the head 10 by a machine which is indicated generally at 30 in FIG. 7.

According to the method of the present invention, the end 20 of each of the contacts mounted in the connector head 10 are connected with the conductor 14 in the following steps.

Step 1:

Each of the cover adaptors 12 is held in a horizontal position so as to face the grooves 26 therein upwards, as shown in FIG. 3. A portion of the coating of the coated wire of the cable C is stripped off from the free end thereof and the remaining portion of the coated conductor 14 extending outwardly from the stripped portion stays as is, as shown in FIG. 4.

Figure 5:
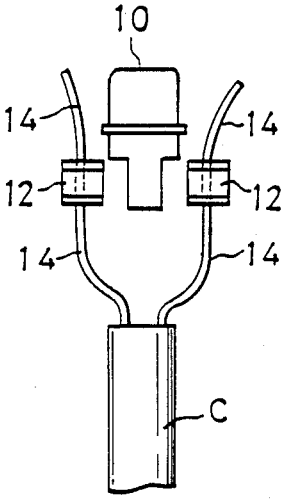
FIG. 5 is a schematic elevation in which each of the cover adaptors is rotated for 90 degrees with respect to its longitudinal axis and closed to each of the sides of the connector head.

Step 2:

The cover adaptor 12 holding the coated conductors 14 is lifted up to a desired position of the connector head 10 which is arranged above the cover adaptor 12, and then it is turned to 90 degrees (FIG. 5). Then the groove 26 on the cover adaptor 12 is aligned to the end portion 22 of the contact 20, and the portion of the conductor 14 extending outwardly from the side of the cover adaptor 12 is cut off therefrom.

Figure 6:
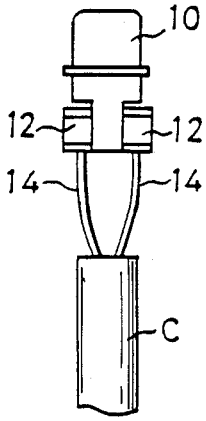
FIG. 6 is a schematic elevation in which the cover adaptors are coupled to the connector head.

Step 3:

Pressure is applied to each of the cover adaptors 12 from the outside thereof so as to press the cover adaptor 12 together with coated conductors 14 into a slit 24 in the end portion 22 of the contact 20 (FIG. 6).

In a preferred embodiment of the present invention, and with particular reference to FIG. 7, a machine for connecting the connector head 10 with the coated electrical conductors or wires of a flat ribbon cable includes a press section 32, a die-set section 34 and a slide-unit section 36.

Figure 8:
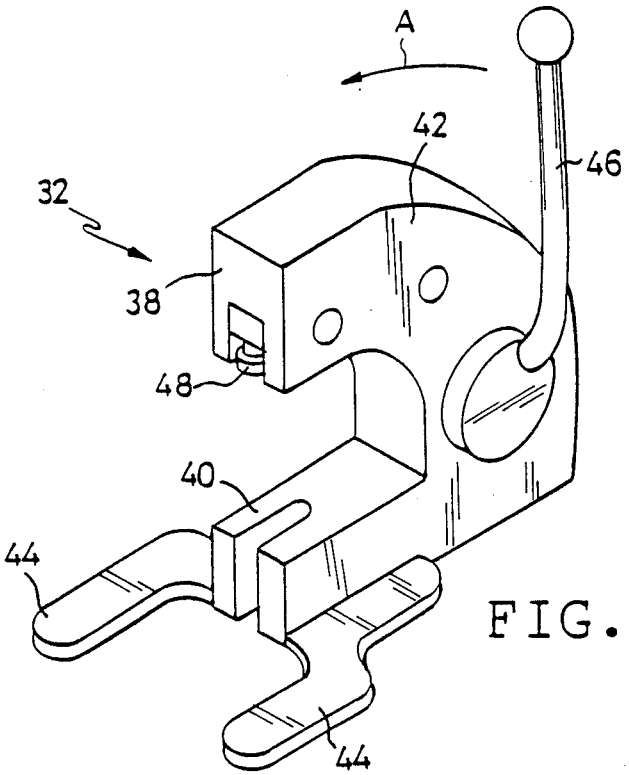
FIG. 8 is a perspective view of a press section of the apparatus according to the invention.
Figure 14:
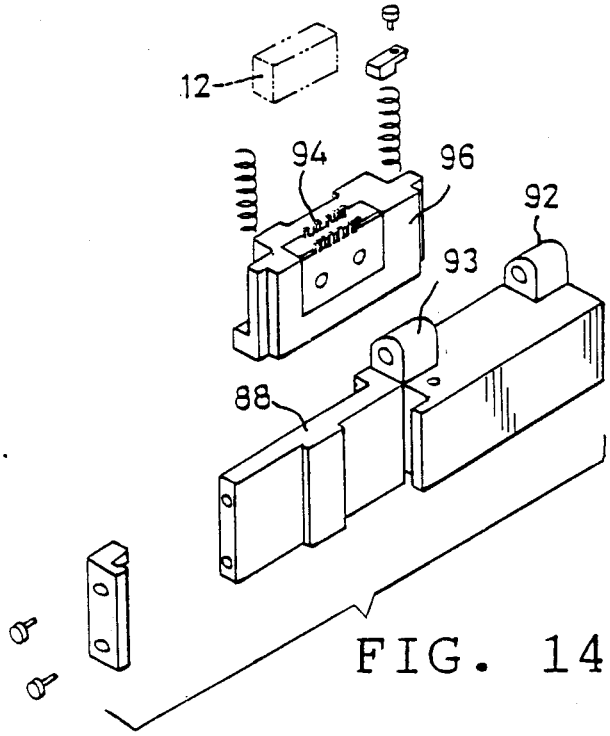
FIG. 14 is a schematic exploded perspective for explaining a cover adaptor support means of the slide-unit.

As shown in FIGS. 7 and 8, the press section 32 which includes a U-like portion 42 formed from an upper arm 38 and a lower arm 40, and a base portion 44 extending outwardly from the lower arm 40 in the form of a horseshoe. The U-like portion 42 is provided with a handle 46 which can be rotated in the direction of the arrow A in FIG. 9. A push rod 48 is slidably mounted to the upper arm 38 of the U-like portion 42. The push rod 48 is operatively connected with the handle 46 by desired conventional means (not shown in the drawings) which is well-known in the art so as to push down the rod 48 when the handle 46 is rotated in the direction of the arrow A.

Figure 9:
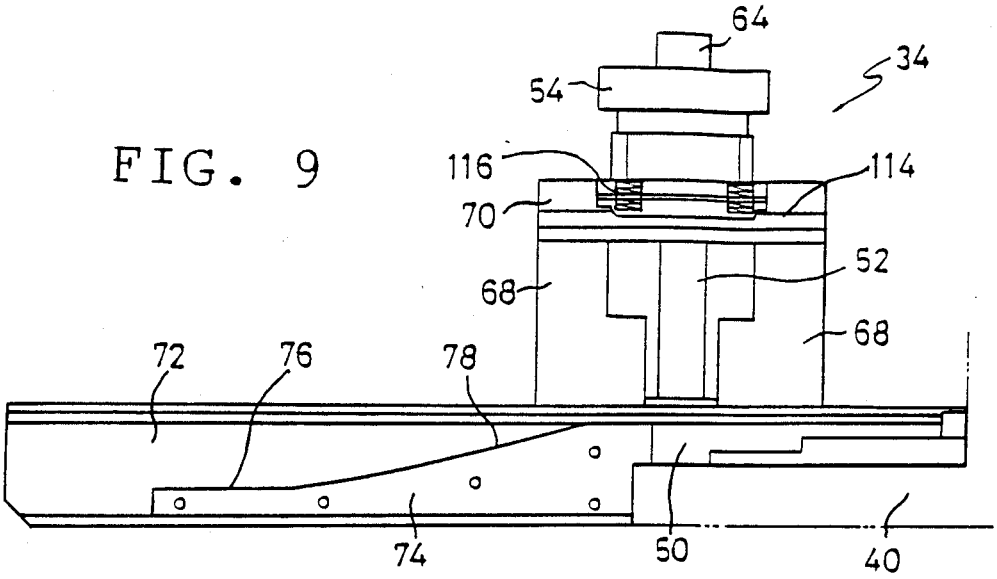
FIG. 9 is a side elevation of the apparatus according to the invention.
Figure 11:
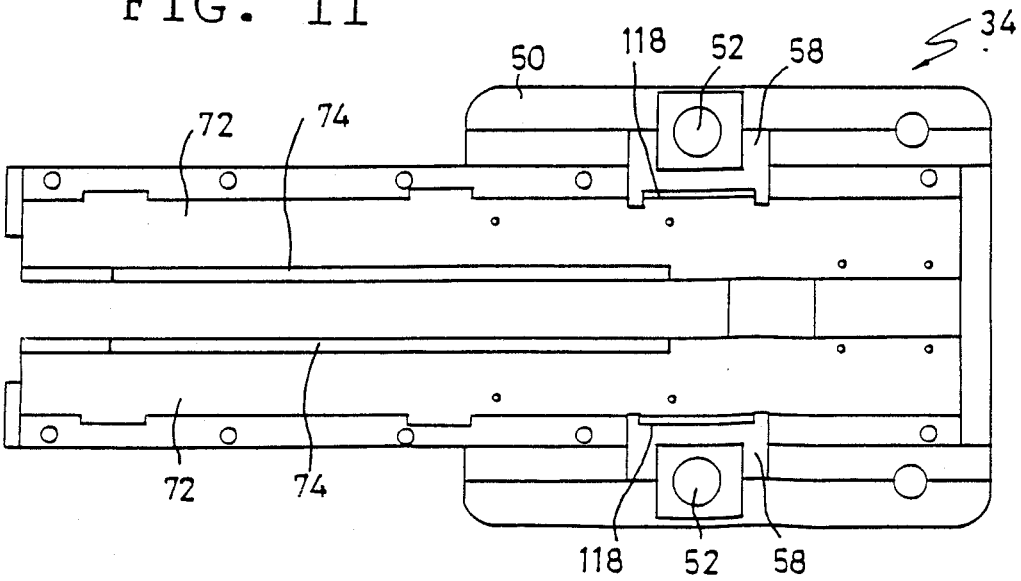
FIG. 11 is a plan view in which an upper plate shown in FIG. 10 is removed.
Figure 10:
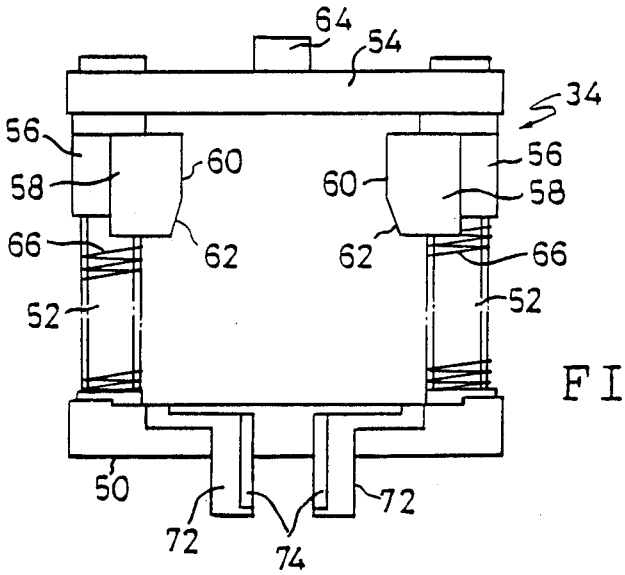
FIG. 10 is a front view of a die-set section.

As clearly shown in FIGS. 9 through 11, the die-set portion 34 includes a base plate 50 to be mounted on the lower arm 40 of the press section 32, a pair of upright columns 52 secured to the base plate 50 and an upper plate 54 which is slidably mounted on the upper end of each of the columns 52. On the lower surface of the upper plate 54, there are provided guide bushes 56 which can slide up and down along the respective column 52 together with the upper plate 54. Each of the guide bush 56 is provided with a cam member 58 having a vertical surface 60 and an inclined plane 62, as shown in FIG. 10. At the central portion of the upper plate 54, there is provided a pedestal member 64 aligned with the push rod 48 of the press section 32. On each of the upright columns 52, a coiled spring 66 is mounted between the base plate 50 and the guide bush 56 so as to lift the upper plate 54 and the cam member 58 unless the handle 46 of the press section 32 is operated.

A pair of side blocks 68 are secured to both sides of the base plate 50 across the column 52. A plate member 70 is secured to the side block 68 on the underside of the upper plate 54. A pair of guide bases 72 are outwardly extended from the inside of the slide block 68 and the inner end of the guide base 72 may be connected with the lower arm 40 of the press section 32.

A rail 74 which is formed from a horizontal surface 76 and an upwardly inclined surface is fixedly secured to the inside of each of the guide bases 72, as shown in FIG. 9.

Figure 12:
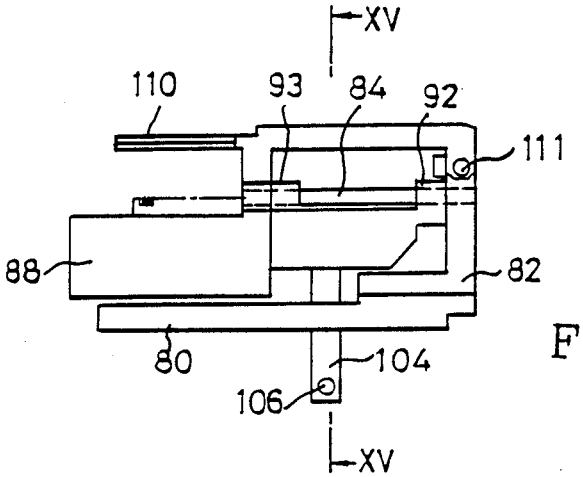
FIG. 12 is a side view of a slide unit of the apparatus according to the invention.
Figure 13:
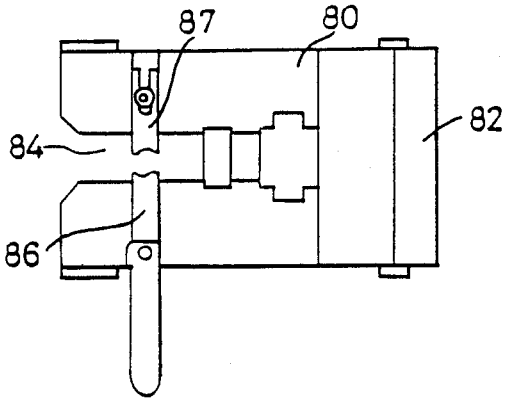
FIG. 13 is a plan view of a slide base plate in the slider unit.

The slide-unit section 36, as shown in FIG. 12, consists of a slide base plate 80 which is slidably mounted on the guide base 72 and L-like rear bracket 82 secured to one end of the slide base plate 80. The slide base plate 80 has a longitudinal opening 84, as shown in FIG. 13, and is provided with clamp means 86; 87 for supporting a portion of the cable C inserted into the opening 84.

A pair of cover adaptor mount supporting members 88 are rotatably mounted on the rear bracket 82 along each side of the opening 84 in the slide base plate 80. To this end, a pair of axes 90 are longitudinally extended along the both sides of the opening 84 in the guide base plate 80, respectively, and bearing portion 92 or 93 of each of the cover adaptor supporting members are rotatably mounted on the axis 90 so as to rotate it from the horizontal position to the vertical position through an angle of 90 degrees about the axis 90.

The cover adaptor 12 can be mounted in the cover adaptor supporting member 88 and in order to facilitate to insert the covered conductors 14 into the respective grooves 26 in the cover adaptor, the cover adaptor supporting member 88 is provided with conductor guide grooves 94 therein.

Figure 15:
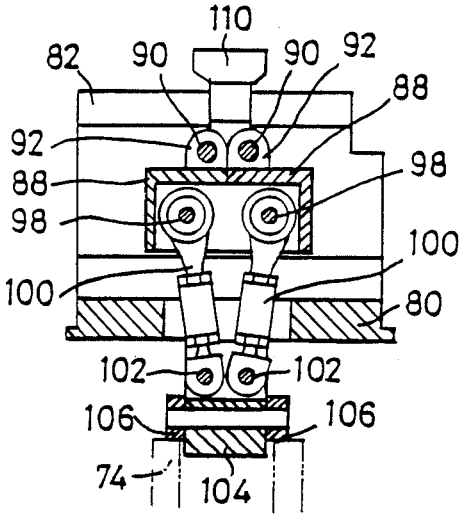
FIG. 15 is a sectional views, looking in the direction of the arrows along line XV—XV of FIG. 12.

The cover adaptor supporting member 88 can be rotated from its original horizontal position to the vertical position through an angle of 90 degrees about the axis 90 when the member 88 is moved from the position shown in FIG. 7 to the direction of the die-set section 34 on the slide base plate 80. To this end, as shown in FIG. 15, one end of a link arm 100 is pivoted by means of a first pin 98 to the cover adaptor supporting member 88, and other end of the link arm 100 is pivoted by means of a second pin 102 to a slide block 104. A pair of rollers 106 are rotatably mounted on both sides of the lower end of the slide block 104, respectively. The roller 106 may be moved from the horizontal surface 76 to the upwardly inclined surface 78 of the rail 74. When the roller 106 reaches to the uppermost end surface of the rail 74, the slide block 104 is lifted up and each of the cover adaptor supporting members 88 is rotated by means of the respective link arms 100 at an angle of 90 degrees by means of the respective link arms 100 at an angle of 90 degrees from its original position shown in FIG. 15. Consequently, the cover adaptors 12 mounted on the respective supporting members 88 are rotated from the original position where the grooves 26 in each of the cover adaptors 12 are in the horizontal position to the vertical position where the grooves 26 face each other in the vertical position. For the convenience of moving the slide base plate 80 by hand along the rail 74, a suitable handle 108 is mounted on the slide base plate 80, as shown in FIG. 7.

At the central portion of the top of the rear bracket 82, a connector holder 110 having an opening 112 in which the connector head 10 may be inserted is pivotally mounted on a shaft 111 so as to rotate it from an inclined position shown in FIG. 11 to an upright position shown in FIG. 7. When the connector holder 110 which is placed in a horizontal position is moved to its upright position by moving the slide unit section 36 in the direction of the press section 32, the connector head 10 in the holder 110 can fixedly secured by a holder plate 114 mounted on the top of the slide block 68 of the die-set section 34 by cooperation of the springs 116.

The operation for connecting the coated conductors 14 of the cable C with the connector head 10 together with the cover adaptors 12 according to the machine 30 of the present invention will be explained in detail.

In operation, in the first place, the slide unit section 36 is placed by operating the handle 108 on a front side of the guide base 72 so that the rollers 106 of the slide unit section 36 stand at a horizontal surface of each of the rails 76. Each of the cover adaptors 12 is mounted in each of the cover adaptor supporting members 88 and the end portion of the coating of each of the coated conductors of the cable C is stripped and the cable C is inserted between the clamp means 86 and 87.

Then the coated conductors 14 are respectively inserted into the groove 26 in the cover adaptor 12 aligned with the groove 94 in the conductor guide member 96, as shown in FIG. 17.

On the other hand, the connector head 10 is mounted in the opening 112 in the connector holder 110, and the slide unit section 36 is moved to the press section 32 by operating the handle 108 while the connector holder is maintained in its upright position as shown in FIG. 7.

Figure 16:
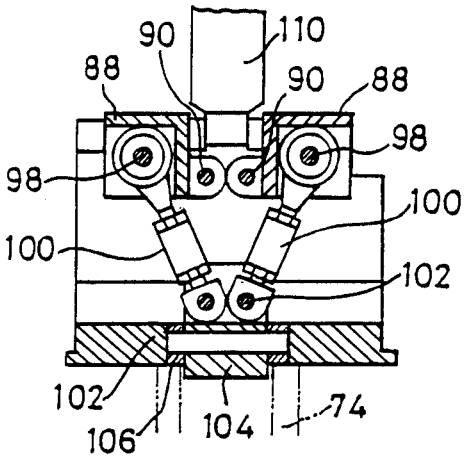
FIG. 16 is a sectional view in which the cover adaptors are turned for 90 degrees.

Thus, the roller 106 of the slide block 104 reaches to the uppermost position of the upwardly inclined cam surface 78 from the horizontal cam surface 76 of the rail 74, and the cover adaptor supporting member 88 turns for 90 degrees from the original position (FIG. 15), as shown in FIG. 16.

When the plate member 70 of the slide unit 36 is forwarded, the cutter 118 which is secured to the die-set portion 34 cuts a portion of the covered conductor 14 extended outwardly from the side of the cover insulator 12.

Where the cable is of a flat ribbon type and ends of the covered conductors in the cable which will be connected to the connector are cut out, the cutter 118 can be omitted.

Figure 19:
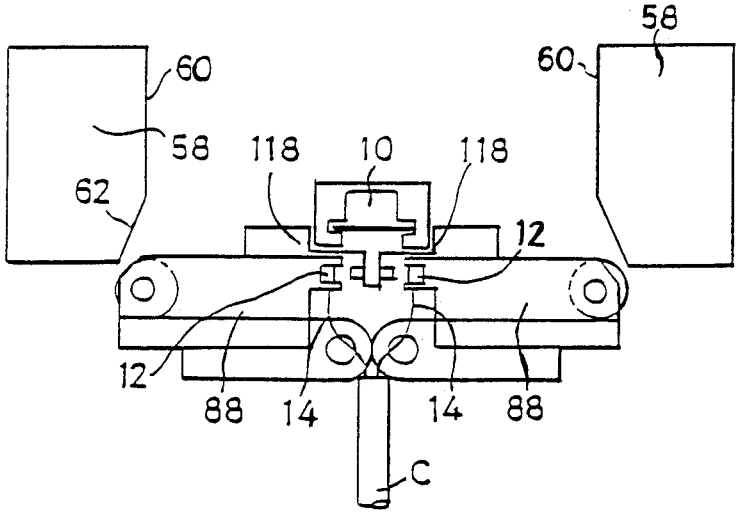
FIG. 19 is a schematic elevation in which the slide-unit is moved to the die-set before the cover adaptors are coupled to the connector head.

In this way, as shown in FIG. 19, the cover adaptor supporting members 88 can aligned with the connector head 10. By operating the handle 46 of the press unit 32 so as to move down the cam member 58 for pushing the cover adaptor 12 mounted on the cover adaptor supporting member 88 to which the conductor is attached can be inserted into the connecting part 22 of the contact 20, and the conductor 14 is connected with the contact 20.

It is to be understood that the form of the present invention herein shown and described is to be taken as a preferred example of the same and that various changes and modifications may be made in the invention without departing from the spirit and scope thereof.

What is claimed is:

1. An apparatus for connecting a connector head having a pair of cover adaptors with a cable comprising;

(a) a press unit having a rotatable handle and a push rod connected with the handle to move the push rod in a vertical direction when the handle is rotated, (b) a die-set unit including an upper arm at the central portion of which the push rod is provided and a lower arm provided with a pair of guide bases, each arm longitudinally extends from one end of the guide base outwardly, a cam rail being secured to the inner side surface of each of the guide bases, the upper surface of the cam rail being formed from a horizontal surface at an outermost end portion of the rail and an upwardly inclined surface at the opposite end to which the rail is connected to the press unit; and (c) a slide unit including a slide base plate slidably mounted on the guide base, a rear bracket secured to one end of the slide base plate, the rear bracket having a pair of shafts extending in parallel to the guide base at the central portion thereof, a pair of cover adaptor supporting means for mounting the cover adaptor on which the cable is mounted, the cover adaptor supporting means being pivotally mounted on each of the shafts, the cover adaptor supporting means being a slide block with rollers guided along the surface of the cam rail and a connector holder pivoted to the rear block in order to support the connector in its upright position.

2. An apparatus as claimed in claim 1 in which the die-set is provided with means for fixing the connector head to the die-set when the connector holder is supported in its upright position.

3. An apparatus as claimed in claim 1 in which the die-set is provided with a cutter for cutting off a free end of each of the covered insulators in the cable.

4. An apparatus as claimed in claim 1 in which the cover adaptor supporting means is provided with guide means for mounting the cover adaptor on the supporting means.

5. An apparatus as claimed in claim 1 in which the slide base plate is provided with a clamp means for supporting the cable to the slide base plate.

* * * * *

UNITED STATES PATENT AND TRADEMARK OFFICE

CERTIFICATE OF CORRECTION

PATENT NO. : 4,965,923

DATED : Oct. 30, 1990

INVENTOR(S) : Hiroshi Kumazara

It is certified that error appears in the above-identified patent and that said Letters Patent is hereby corrected as shown below:

Title Page:

Item [73] Assignee

"Inc." should be --Ltd.--

Signed and Sealed this

Twenty-fifth Day of August, 1992

*Attest:*

DOUGLAS B. COMER

*Attesting Officer*

*Acting Commissioner of Patents and Trademarks*